US005338587A

United States Patent [19]

Mammino et al.

[11] Patent Number: 5,338,587

[45] Date of Patent: Aug. 16, 1994

[54] ELECTROGRAPHIC METHODS

[75] Inventors: Joseph Mammino, Penfield; Dennis Abramsohn, Pittsford; George J. Heeks, Rochester; Arnold W. Henry, Pittsford; Louis D. Fratangelo, Fairport; David H. Pan, Rochester; Santokh S. Badesha, Pittsford, all of N.Y.

[73] Assignee: Xerox Corporation, Stamford, Conn.

[21] Appl. No.: 175,661

[22] Filed: Dec. 30, 1993

Related U.S. Application Data

[63] Continuation of Ser. No. 54,172, Apr. 30, 1993, abandoned.

[51] Int. Cl.[5] ..... G05G 13/22

[52] U.S. Cl. ..... 428/35.7; 430/126; 430/48; 355/211; 346/153.1; 428/35.8; 428/36.9; 428/421; 428/447; 428/450; 428/451; 428/457; 428/461

[58] Field of Search ..... 430/48, 126; 355/211; 346/153.1; 428/35.7, 35.8, 36.9, 421, 447, 450, 451, 457, 461

[56] References Cited

U.S. PATENT DOCUMENTS

| | | | |
|---|---|---|---|
| 4,029,827 | 6/1977 | Imperial et al. | 427/22 |
| 4,101,686 | 7/1978 | Strella et al. | 427/22 |
| 4,185,140 | 1/1980 | Strella et al. | 428/418 |
| 4,257,699 | 3/1981 | Lentz | 355/3 |
| 4,264,181 | 4/1981 | Lentz et al. | 355/3 |
| 4,272,179 | 6/1981 | Seanor | 355/3 |
| 4,378,389 | 3/1983 | Maruyama et al. | 427/387 |
| 4,659,621 | 4/1987 | Finn et al. | 428/339 |
| 4,764,560 | 8/1988 | Mitchell | 524/506 |
| 4,777,087 | 10/1988 | Heeks et al. | 428/321.1 |
| 4,830,924 | 5/1989 | Dallavia, Jr. | 428/429 |
| 4,839,690 | 1/1989 | Onoda et al. | 355/211 |
| 4,849,469 | 7/1989 | Crosby et al. | 524/439 |
| 4,853,737 | 8/1989 | Hartley et al. | 355/289 |
| 5,141,788 | 8/1992 | Badesha et al. | 428/36.8 |
| 5,166,031 | 11/1992 | Badesha et al. | 430/124 |
| 5,213,922 | 5/1993 | Matsuo et al. | 430/48 |

OTHER PUBLICATIONS

Encyclopedia of Polymer Science and Engineering, vol. 8, 1987, "Interpenetrating Polymer Networks", pp. 279–284, 294–295, 329–337.

Henry, Arnold W. et al. "Improving Release Performance of Viton Fuser Rolls", *Xerox Disclosure Journal*, vol. 9, #1, Jan./Feb. 1984, p. 43.

Ferguson, Robert M., et al., "Viton/RTV Silicone Fuser Release Overcoating," *Xerox Disclosure Journal*, vol. 11, #5, Sep./Oct. 1986, p. 207.

*Primary Examiner*—Patrick J. Ryan
*Assistant Examiner*—Marie R. Macholl
*Attorney, Agent, or Firm*—John L. Haack

[57] ABSTRACT

An electrographic imaging member comprising a supporting substrate and an outer layer of a volume grafted fluoroelastomer comprised of a substantially uniform integral interpenetrating or crosslinked network of a polyorganosiloxane grafted fluoroelastomer.

10 Claims, 1 Drawing Sheet

ELECTROGRAPHIC METHODS

This is a continuation of application Ser. No. 054,172, filed Apr. 30, 1993, now abandoned.

CROSS REFERENCE TO RELATED APPLICATIONS AND PATENTS

Attention is directed to the following copending applications commonly assigned to the assignee of the present application, U.S. application Ser. No. 08/035,023; U.S. application Ser. No. 07/815,215 now U.S. Pat. No. 5,266,431; U.S. application Ser. No. 07/887,943, now U.S. Pat. No. 5,257,045 ; U.S. application Ser. No. 08/044,870, filed Apr. 8, 1993; and U.S. application Ser. No. 08/044,860, filed Apr. 8, 1993.

Attention is also directed to commonly assigned U.S. Pat. No. 5,166,031, issued Nov. 24, 1992, entitled "Materials Package for Fabrication of Fusing Components" and U.S. Pat. No. 5,141,788, issued Aug.25, 1992, entitled "Fuser Member".

BACKGROUND OF THE INVENTION

This invention relates in general to electrography and, in particular, to hybrid compounds, thin films and processes for preparing and using the hybrid compounds and thin films in, for example, preparing dielectric electroreceptor devices for use with liquid ink development systems. In fabricating electrographic imaging members, there is a need for materials which can be easily prepared and which have a high level of mechanical stability and solvent resistance. There are known a number of methods and materials for forming electrographic imaging members, for example, the aforementioned copending application U.S. application Ser. No. 07/815,215 filed Dec. 31, 1991. Illustrated in the copending applications are devices having blocking layers which layers are required for the devices to be effective.

In electrography, an electrostatic latent image is formed on a dielectric imaging layer (electroreceptor) by various techniques such as by an ion stream (ionography), stylus, shaped electrode, and the like. Development of the electrostatic latent image may be effected by the application of certain electrostatically charged marking particles in either dry form or dispersed in liquid media.

A hybrid composition or volume grafted elastomer comprising a fluoroelastomer and a polyorganosiloxane that forms an integral interpenetrating network has been disclosed in the aforementioned commonly assigned U.S. Pat. No. 5,166,031. The volume graft composition was used in fabricating a thermal fusing member for use, for example, in fusing electrographic toner images.

Fluoroelastomers, such as VITON ®, may be coated directly onto metallic substrates such as aluminum, steel or other suitable ground planes to form dielectric receivers. When these fluoroelastomer coated ground plane devices are corona charged by known means, the devices exhibit high charge injection rates which results in noncapacitive charging thereby causing high charge decay rates and low development potentials. These results render fluoroelastomer coated devices undesirable from a charging perspective. However, fluoroelastomers possess desirable mechanical properties, for example, durability, flexibility, solvent resistance, and the like, which make them particularly attractive for use in electroreceptor devices. The aforementioned high charge injection rates can be controlled and lowered by applying a blocking layer at an interface formed between the ground plane and the fluoroelastomer. However, the application of the blocking layer requires an additional coating step and additional drying and curing time which may reduce yields and unnecessarily inflates manufacturing costs.

There continues to be a need for improved fluoroelastomers or hybrid compositions which embody both desired mechanical properties and low charge injection rate properties and which fluoroelastomers or hybrid compositions may be directly applied to a ground plane metallic substrate in a single step without requiring the application of an intermediate blocking layer at the interface between the ground plane and the dielectric fluoroelastomer layer in a separate step. There is a continuing need for electroreceptor devices that are: convenient to prepare, economic, environmentally acceptable, mechanically stable and highly durable, having low charge injection and high capacitive charging properties.

SUMMARY OF THE INVENTION

In an object of the present invention, the electrographic imaging member has a receiving layer or an outer layer comprised of a volume grafted elastomer which is a substantially uniform integral interpenetrating network of a hybrid composition of a fluoroelastomer and a polyorganosiloxane, where the volume graft is formed by dehydrofluorination of said fluoroelastomer by a dehydrofluorinating agent, followed by a free radical addition or polymerization reaction by the addition of an alkene or alkyne functionally terminated polyorganosiloxane and a polymerization initiator.

In another object of the present invention, the fluoroelastomer is selected from the group consisting of poly(-vinylidene fluoride-hexafluoropropylene) and poly(-vinylidene-hexafluoropropylene-tetrafluoroethylene).

In a further aspect of the present invention, the polyorganosiloxane has the formula:

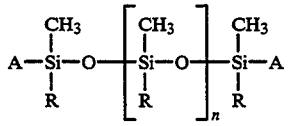

where R is independently an alkyl, alkenyl or aryl with from about 1 to 20 carbon atoms or an aryl group substituted with an amino, hydroxy, mercapto or alkyl or alkenyl group having less than 20 carbon atoms. The functional group A, is independently an alkene or alkyne with from about 2 to about 8 carbon atoms or an alkene or alkyne substituted with an alkyl or aryl group with from about 1 to about 20 carbon atoms and n is a number representing siloxane monomeric units and is about 2 to about 350.

In accordance with another object of the present invention, a long life electrographic imaging member together with a process for making the electrographic imaging member which does not require a prior deposition or application of a blocking layer prior to the deposition of the dielectric layer.

In yet another object of the present invention, the dehydrofluorinating agent is selected from the group consisting of primary, secondary and tertiary aliphatic and aromatic amines where the aliphatic and aromatic groups have from about 2 to about 15 carbon atoms.

In still yet another object of the present invention the dehydrofluorinating agent is a primary aliphatic amine such as an alkyl amine having up to 20 carbon atoms.

Another object of the present invention provides free radical polymerization initiators selected from the group consisting of aliphatic and aromatic peroxides and azo compounds, with benzoyl peroxide and azoisobutyronitrile free radical initiators being preferred.

In a further object of the present invention, a supporting substrate is a cylindrical sleeve, drum, endless belt or drum-belt hybrid, and the like, having an outer coating layer of volume grafted fluoroelastomer from 6 to about 200 micrometers thick.

Another object of the present invention provides for an electrographic imaging member which includes an optional intermediate elastomer layer such as a silicone or fluoroelastomer layer and the volume grafted fluoroelastomer layer as an overcoating.

In another object of the present invention is provided a method of making an electrographic imaging member having a supporting substrate and a volume graft charge retentive layer comprising, in embodiments, applying a solution of the volume graft to the supporting substrate and forming a coating layer thereon to form a uniform durable outer layer on the substrate comprised of the volume grafted fluoroelastomer material.

In still yet another object of the present invention is provided an electrographic imaging member that may be used as dielectric receiver with dry or liquid developer systems.

It is another object of the present invention to provide a substrate having a bulk conductivity of less than or equal $10^8$ ohm/cm and has a conduction coating applied thereto as a ground plane.

Another object of the present invention is to provide a substrate having mechanical and thermal properties that allows pressure transfer of toner images to a receiver sheet, preferably with heat.

The foregoing objects are accomplished in accordance with this invention in embodiments by providing an electrographic imaging member comprising a supporting substrate and an outer layer of a volume grafted elastomer which is a substantially uniform integral interpenetrating network of a hybrid composition comprising a fluoroelastomer and a polyorganosiloxane, said volume graft having been formed by: dehydrofluorination of said fluoroelastomer by a dehydrofluorinating agent; free radical grafting or addition of an alkene or alkyne functionally terminated polyorganosiloxane and a free radical initiator to the fluoroelastomer; and subsequent curative crosslinking of the siloxane grafted fluoroelastomer product.

BRIEF DESCRIPTION OF THE DRAWINGS

FIG. 1 shows representative charging at 26 nanocoloumbs/$cm^2$ for each cycle for 25 cycles for control or comparative device fabricated from VITON only as described in COMPARATIVE EXAMPLE I.

FIG. 2 shows representative charging at 26 nanocoloumbs/$cm^2$ for each cycle for 25 cycles for a device fabricated from volume grafted VITON of EXAMPLE II. The control device of FIG. 1 reaches a level of about 200 volts where all charges deposited during a 1 second cycle are lost due to a charge decay mechanism. The sample device of FIG. 2 prepared in EXAMPLE II charges more capacitively, to over 500 volts and retains most of the charge with little decay.

DETAILED DESCRIPTION OF THE INVENTION

Figure 1:
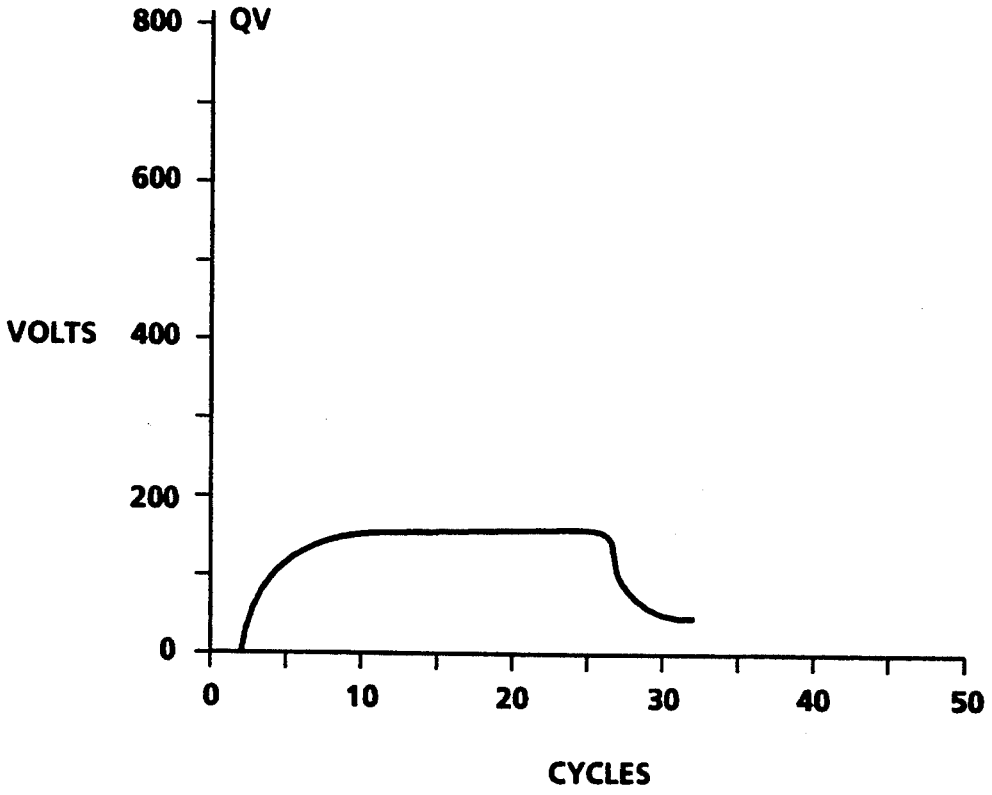
FIGS. 1 and 2 are QV curves which show averaged values of measured voltage versus charge cycles for a comparative control device and a representative Example device measured at, for example, 0.5 seconds after charging, respectively, of the present invention.

The present invention relates to the application of a hybrid composition of a fluoroelastomer, for example, VITON® and a polyorganosiloxane which is referred to hereafter a "volume graft" for use as a dielectric receiver. The hybrid composition may be prepared by chemically bonding, for example, an oligomeric or polymeric vinyl terminated dimethyl siloxane to VITON® by the dehydrohalogenation reaction and free radical addition followed by curative crosslinking of the siloxane grafted fluoroelastomer. The hybrid volume grafted fluoroelastomers of the present invention have excellent mechanical, thermal and physical properties in that these hybrid materials typically have a long wearing life, for example, imaging devices prepared according to the present invention may be used for in excess of 5,000,000 imaging cycles, and maintain toughness and strength in either a dry or liquid developer environments. Imaging members of the present invention may be employed in an electrographic imaging process, particularly for high speed ionographic and liquid immersion development color printing processes.

Use of the term "volume graft" is intended to define in embodiments a hybrid layer of polyorganosiloxane which is both grafted or covalently bonded to a fluoroelastomer and which grafted material is also cross linked. The term covalently bonded is intended to define the chemical bonding between a polymer backbone or chain carbon atom of the fluoroelastomer and a functionally reactive atom or site of the polyorganosiloxane. These bonds could be C—C, C—O, C—N, C—Si, and the like, depending upon the functionality selected. In the present invention a C—C linkage between the polyorganosiloxane and the fluoroelastomer is preferred for mechanical and structural integrity and for ease and convenience of preparation. By the term volume graft, it is intended to define a substantially uniform integral interpenetrating network of a hybrid composition, wherein both the structure and the composition of the fluoroelastomer and polyorganosiloxane are substantially uniform when taken through different or random sections or slices of the electrographic member, that is, homogeneous.

The term hybrid composition in embodiments is intended to define a volume grafted composition which is comprised of randomly siloxane grafted fluoroelastomer and randomly intermolecularly cross linked siloxane grafted fluoroelastomers.

The term interpenetrating network in embodiments is intended to define the addition polymerization matrix where siloxane grafted fluoroelastomer polymer strands are intertwined and cross linked with one another.

Electroreceptor imaging members are well known in the art. Electroreceptor imaging members may be prepared by various suitable techniques. Typically, a flexible or rigid substrate is provided having an electrically conductive surface which may be the same or differ from the substrate. A charge retentive layer is then applied to the electrically conductive surface. A charge blocking layer may optionally be applied to the electrically conductive surface prior to the application of the charge retentive layer. If desired, an adhesive layer may be utilized between the charge blocking layer and the charge retentive dielectric layer.

The substrate may comprise numerous suitable materials having the required mechanical and thermal properties. Accordingly, the substrate may comprise a layer of an electrically nonconductive or conductive material such as an inorganic or an organic composition. Typical conductive substrates are stainless steel, nickel, aluminum, copper, brass, and the like. As electrically nonconducting materials there may be employed various resins known for this purpose including: liquid crystal polymers, phenolics, polyphenylene ether alloys, polyphenylene oxide alloys, poly(amide-imides), polyarylates, polyarylsulfone, polybenzimidazole, polyetheretherketone, polyetherimide, polyetherketone, polyesters, polyimides, polyphenylene sulfide, polysulfones, polycarbonates, polyamides, polyurethanes, and the like, which may be rigid or flexible. The electrically insulating or conductive substrate may be in the form of an endless flexible belt, a web, a rigid cylinder, a sheet, a sleeve, a belt-drum hybrid, and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are no adverse effects on the final electroreceptor device.

The electrically conductive layer, which may be the same or different from the substrate depending upon the device structure and performance desired, may vary in thickness over substantially wide ranges depending, for example, on the degree of flexibility desired for the electroreceptor member. Accordingly, for a flexible imaging device, the thickness of the conductive layer may be between about 20 Angstrom units to greater than about 1,000 Angstrom units, and more preferably from about 100 Angstrom units to about 750 Angstrom units for an optimum combination of electrical conductivity and flexibility. The conductive layer may be an electrically conductive metal layer formed, for example, on the flexible substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, for example, a polyester web substrate such as MYLAR ® available from E. I. du Pont de Nemours & Co., with magnetron sputtering. Alternatively, the conductive layer may be prepared by dispersing conductive metal flakes or particles, as suitably conductive pigment particles in a suitable binder resin.

If desired, an alloy of suitable metals may be deposited on the substrate. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electroreceptor imaging members in slow speed devices is about $10^5$ ohms/square.

After formation of an electrically conductive surface, an optional charge blocking layer or barrier layer may be applied thereto. Generally, electron blocking layers for positively charged electroreceptors prevent holes from the imaging surface from migrating toward the conductive layer. Any suitable blocking layer capable of forming an electronic barrier to charge injection at the interface of the dielectric layer and the conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in (U.S. application Ser. Nos. 4,338,387, 4,286,033 and 4,291,110). A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment, and the like. The blocking layer should be continuous and have a thickness of less than about 0.2 micrometer because greater thicknesses may lead to undesirably higher voltages for the dielectric layer of the electrophotoreceptor. Drying of the deposited coating may be effected by any suitable conventional technique such as oven drying, infrared radiation drying, air drying, and the like.

An optional adhesive layer may be applied to the blocking layer or conductive layer. Any suitable adhesive layer well known in the art may be utilized. Typical adhesive layer materials include, for example, polyesters, duPont 49,000 (available from E. I. DuPont de Nemours and Company), Vitel PE100 (available from Goodyear Tire & Rubber), polyurethanes, and the like. Satisfactory results may be achieved with adhesive layer thickness between about 0.05 micrometer (500 Angstroms) and about 0.3 micrometer (3,000 Angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying, and the like. In some cases, the charge blocking layer and the adhesive layer may be the same material.

Any suitable and conventional technique may be utilized to mix and thereafter apply the latent volume graft layer coating mixture to form the charge retentive or dielectric layer. By use of the term "latent volume graft layer" is meant that the mixture applied to form the dielectric layer contains a siloxane grafted fluoroelastomer and curative crosslinking system which system is activated, with for example, with heating in an oven, after coating to produce the desired crosslinked siloxane grafted fluoroelastomer or volume graft layer. Typical application techniques include spraying, dip coating, roll coating, wire wound rod coating, and the like. Drying of the deposited coating may be effected by any suitable conventional technique such as oven drying, infrared radiation drying, air drying, and the like.

The volume grafting according to the present invention is performed in three distinct reactive steps, the first involves the dehydrofluorination of the fluoroelastomer preferably using an amine or an aminosilicone compound. During this step hydrofluoric acid is eliminated from the fluoroelastomer polymer backbone and generates unsaturation, carbon to carbon double bonds, on the fluoroelastomer polymer chain or backbone. The second step is the free radical peroxide induced addition of the alkene or alkyne terminated polyorganosiloxane to the carbon to carbon double bonds of the dehydrofluorinated fluoroelastomer as summarized, for example, in the accompanying scheme. The subscripts x and y represent fluorinated and dehydrofluorinated, respectively, monomeric units within the fluoroelastomer, base represents an aforementioned dehydrofluorinating agent, and $CH_2{=}CH{-}(SiOR_2)_n{-}CH{=}CH_2$ represents, for example, in embodiments, a suitable alkene functionalized polyorganosiloxane grafting component where n is defined herein. The product shown in the reaction scheme may react further via a free radical processes to form higher molecular weight crosslinked or extended structures depending on the conditions used and reactant stoichiometry selected. The third step comprises a curative process wherein the siloxane grafted fluoroelastomer is intermolecularly crosslinked to form the desired interpenetrating network or volume graft layer.

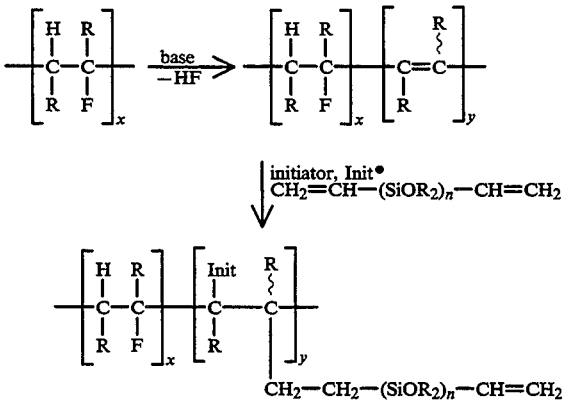

The fluoroelastomers that are useful in the practice of the present invention are described in detail in U.S. Pat. No. 4,257,699 to Lentz, as well as those described in commonly assigned U.S. Pat. No. 5,061,965. As described therein these fluoroelastomers, particularly from the class of copolymers and terpolymers of vinylidenefluoride, hexafluoropropylene and tetrafluoroethylene, known commercially under various designations as VITON A, VITON E, VITON E60C, VITON E430, VITON 910, VITON GH and VITON GF. Other commercially available materials include FLUOREL 2170, FLUOREL 2174, FLUOREL 2176, FLUOREL 2177 and FLUOREL LVS 76. Additional commercially available materials include AFLAS a poly(propylene-tetrafluoroethylene), FLUOREL II (LII900) a poly(propylene-tetrafluoroethylene-vinylidenefluoride) both also available from 3M Company, and the TECNOFLONS identified as FOR-60KIR, FOR-LHF, NM, FOR-THF, FOR-TFS, TH, TN505 available from Montedison Specialty Chemical Co. Typically, these fluoroelastomers are cured with a nucleophilic addition curing system, such as a bisphenol crosslinking agent with an accelerator as described in further detail in the above referenced '699 Lentz Patent. A preferred curing system is a nucleophilic system with a bisphenol cross linking agent to generate a covalently cross-linked network polymer formed by the application of heat following grafting of the fluoroelastomer copolymer. The nucleophilic curing system may also include an organophosphonium salt, and the like, accelerator. Some of the commercially available fluoroelastomer polymers which can be cured with the nucleophilic system are VITON E 60C, VITON B 910, VITON E 430, VITON A, VITON B, VITON GF.

In a particularly preferred embodiment, the fluoroelastomer is one having a relatively low quantity of vinylidenefluoride, such as in VITON GF. The VITON GF has 35 mole percent vinylidenefluoride, 34 percent hexafluoropropylene and 29 mole percent tetrafluoroethylene with 2 percent cure site monomer. It may generally be cured with a conventional aliphatic peroxide curing agent such as lauryl peroxide, and the like, as described herein.

The polyorganosiloxane having functionality according to the present invention has the formula:

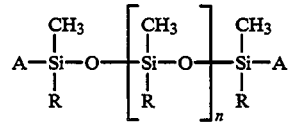

where R is independently an alkyl, alkenyl or aryl with from 1 to about 20 carbon atoms or an aryl group substituted with an amino, hydroxy, mercapto or an alkyl or alkenyl group with from 1 to about 20 carbon atoms. The functional group A, is independently an alkene or alkyne group having about 2 to about 8 carbon atoms or an alkene or alkyne substituted with an alkyl or aryl group with from 1 to about 20 carbon atoms and n is a number and represents siloxane monomer units and is of from about 2 to about 350. In the above formula, typical R groups include methyl, ethyl, propyl, octyl, vinyl, allylic crotnyl, phenyl, naphthyl and phenanthryl and typical substituted aryl groups are substituted in the ortho, meta or para positions with lower alkyl groups having less than about 15 carbon atoms. Furthermore, in a preferred embodiment n is between about 60 and about 80 to provide a sufficient number of reactive groups to graft onto the fluoroelastomer. Typical alkene and alkenyl functional groups include vinyl, acrylic, crotonic and acetylenic which may typically be substituted with methyl, propyl, butyl, benzyl, tolyl groups, and the like.

The dehydrofluorinating agent which attacks the fluoroelastomer thereby generating unsaturation is selected from the group of strongly basic agents such as peroxides, hydrides, bases, oxides, and the like. Preferred dehydrofluorinating agents are selected from the group consisting of primary, secondary and tertiary, aliphatic and aromatic amines, where the aliphatic and aromatic groups with from 2 to about 15 carbon atoms. The group also includes aliphatic and aromatic diamines and triamines with from about 2 to about 15 carbon atoms where the aromatic groups may be benzene, toluene, naphthalene, anthracene, and the like. It is generally preferred for the aromatic diamines and triamines that the aromatic group be substituted in the ortho, meta or para positions. Typical substituents include lower alkylamino groups such as ethylamino, propylamino and butylamino with propylamino being preferred. Specific amino silane dehydrofluorinating agents include N-(2 aminoethyl-3-aminopropyl)-trimethoxy silane, 3-(N-styrylmethyl-2-aminoethylamino) propyltrimethoxy silane hydrochloride and (aminoethylamino methyl) phenethyltrimethoxy silane.

The dehydrofluorinating agent generates double bonds by dehydrofluorination of the fluoroelastomer compound so that when the terminally unsaturated polyorganosiloxane is added with the initiator, the addition or polymerization of the siloxane on the fluoroelastomer is initiated. Typical free radical polymerization initiators for this purpose are benzoyl peroxide, azoisobutyronitrile (AIBN), and the like.

Other adjuvants and fillers may be incorporated in the hybrid siloxane elastomer in accordance with the present invention as long as they do not affect the integrity of the volume grafted fluoroelastomer. Such fillers normally encountered in the compounding of elastomers include coloring agents, reinforcing fillers, crosslinking agents, processing aids, accelerators and polymerization initiators. Following coating of the latent volume graft on to the substrate, it is subjected to a stepwise curing process wherein, for example, heating is for two hours at 93° C. followed by 2 hours at 149° C. followed by 2 hours at 177° C. followed by 2 hours at 208° C. and 16 hours at 232° C.

The substrate for the electroreceptor imaging member according to the present invention may be of any suitable material. In one instance, it takes the form of a cylindrical tube of aluminum, steel or certain plastic materials chosen to maintain rigidity, structural integrity, as well as being capable of having a silicone elastomer coated thereon and adhered firmly thereto. Typically, the electroreceptor imaging member substrates may be made by injection, blow, compression or transfer molding, or they may be extruded. In a typical procedure the substrate which may be a steel cylinder is degreased with a solvent and cleaned with an abrasive cleaner prior to being primed with a primer such as Dow Corning 1200 which may be sprayed, brushed or dipped followed by air drying under ambient conditions for thirty minutes and then baked at 150° C. for 30 minutes. A silicone elastomer or similar intermediate layer may optionally be applied according to conventional techniques such as injection molding and casting after which it is cured for up to 15 minutes and at 120° to 180° C. to provide a complete cure without a significant post cure operation. The silicone elastomer intermediate layer may be pigmented with carbon, metal flakes, and the like, to achieve a resistivity of $\leqq 10^8$ ohm/cm and have a Shore A durometer value of about 40 to 80 and a thickness of about 12.5 micrometers to about 1,000 micrometers. The intermediate curing operation should be substantially complete to prevent debonding of the silicone elastomer from the substrate when it is removed from the mold. Thereafter the surface of the silicone elastomer is sanded to remove the mold release agent and it is wiped clean with a solvent such as isopropyl alcohol to remove all debris.

The outer layer of the electroreceptor imaging member is preferably prepared by dissolving the ungrafted fluoroelastomer in a typical solvent, such as methyl ethyl ketone (MEK), methyl isobutyl ketone (MIBK), and the like, followed by stirring for 15 to 60 minutes at 45° to 85° C. after which the free radical initiator, which is generally dissolved in an aromatic solvent such as toluene, is added with continued stirring for 5 to 25 minutes. Subsequently, the polyorganosiloxane is added with stirring for 30 minutes to 10 hours at a temperature of about 45° to 85° C. A curing package such as, VITON CURATIVE No. 50, which incorporates an accelerator, (a quarternary phosphonium salt or salts) and a crosslinking agent, bisphenol AF in a single curative system is added in a 3 to 7 percent solution predissolved in the fluoroelastomer compound. Optimally, the basic metal oxides or hydroxides, such as MgO and $Ca(OH)_2$, can be added in particulate form to the solution mixture. Providing the charge retentive layer on the electroreceptor imaging member substrate is most conveniently carried out by spraying, dipping, and the like, a solution of the homogeneous suspension of the siloxane grafted fluoroelastomer containing the curative system to a level of film of about 6 to about 200 micrometers in thickness. This thickness range is selected as providing a layer thin enough to minimize cost of the device and thick enough to allow a reasonable wear life and preferrable charging properties. While molding, extruding and wrapping techniques are alternative means which may be used, a preferred means is to spray successive applications of a solvent solution. When the desired thickness of coating is obtained, the coating is cured and thereby bonded to the substrate. A typical stepwise curing process is heating for two hours at 93° C. followed by 2 hours at 149° C. followed by 2 hours at 177° C. followed by 2 hours at 208° C. and 16 hours at 232° C.

In an alternative procedure, the solvent may be removed by evaporation by known means, the residue rinsed with a hydrocarbon solvent such as hexane to remove unwanted reactants, if any, and the residue redissolved in the original solvent followed by the addition of VITON CURATIVE No. 50 and subsequent formation of an outer layer.

Other layers may also be used such as conventional electrically conductive ground strip along one edge of the belt or drum in contact with the conductive layer, blocking layer, or adhesive layer to facilitate connection of the electrically conductive layer of the electroreceptor to ground or to an electrical bias. Ground strips are well known and usually comprise conductive particles dispersed in a film forming binder.

Optionally, a protective overcoat layer may also be utilized to enhance resistance to abrasion. In some cases an anti-curl back coating may be applied to the side opposite the outer electroreceptor layer to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers.

The devices employing a hybrid charge retentive layer of the present invention exhibit numerous advantages such as extremely stable charge and operational life longevities. Moreover, high stable charge and mechanical integrities are maintained during extended cycling in a machine employing liquid development systems comprised of, for example, hydrocarbon solvents.

The imaging member of the present invention may be employed in an electrographic imaging process comprising:

(a) providing an electroreceptor imaging member comprising: a supporting substrate, a conductive ground plane, an optional blocking barrier layer, an optional adhesive layer, a charge retentive layer comprising a volume grafted elastomer which is a substantially uniform integral interpenetrating or crosslinked network of a hybrid composition comprising a polyorganosiloxane grafted fluoroelastomer;

(b) depositing a uniform electrostatic charge on the imaging member or discharging the receiving member to a low or uniform voltage;

(c) creating an electrostatic latent image by imagewise deposition of charged particles on the imaging member;

(d) developing the electrostatic latent image with electrostatically attractable marking particles to form a toner image using dry or liquid developer;

(e) transferring the toner image to a receiving member;

(f) cleaning; and (g) repeating the charging, image writing, developing, transferring, and cleaning steps.

X-ray Photoelectron Spectroscopy (XPS) Characterization of the Volume Grafted Layer.

The electrographic imaging members prepared in the present invention may have the volume grafted fluoroelastomer layer conveniently characterized using X-ray photoelectron spectroscopy as described below.

1. Preparation of Surface - The volume grafted fluoroelastomer layer prepared in EXAMPLE II was sequentially solvent extracted with hexane or 90/10 hexane/methyl ethyl ketone mixed solvents 3 to 4 times to remove unreacted fluoroelastomer and siloxane.
2. XPS Characterization - The extracted layer remaining was then examined with X-ray photoelectron spectroscopy which provides the chemical composition of the topmost 5 to 10 nanometers of the layer surface. The surface was then sliced two times and XPS analysis indicated that polysiloxane is uniformly distributed throughout the fluoroelastomer film.

The following Examples further define and describe ionographic imaging members prepared by the present invention and illustrate preferred embodiment of the present invention. Unless otherwise indicated, all parts and percentages are by weight. A comparative Example is given.

EXAMPLE I

Preparation of Siloxane and VITON Volume Graft Material

A volume graft elastomer was prepared by dissolving 250 grams of VITON GF TM in 2.5 liters of methylethyl ketone (MEK) by stirring at room temperature. This was performed in a 4 liter plastic bottle using a moving base shaker for about one hour to two hours to accomplish the dissolution depending upon the speed of the shaker. The above solution is then transferred to a 5 liter Erlenmyer flask and 25 milliliters of the amine dehydrofluorinating agent, 3-(N-styrylmethyl-2-aminoethylamino) propyltrimethoxysilane hydrochloride (S-1590, available from Huls America Inc., Piscataway, N.J.) was added. The contents of the flask were then stirred using a mechanical stirrer while maintaining the temperature between 55° and 60° C. After stirring for 30 minutes, 50 milliliters of 100 centistoke vinyl terminated polysiloxane (PS-441) also available from Huls America Inc., was added and stirring was continued for another ten minutes. A solution of 10 grams of benzoyl peroxide in a 100 milliliter mixture of toluene and MEK (80:20) was then added. The stirring was continued while heating the contents of the flask at about 55° C. for another 2 hours. During this time, the color of the solution turned light yellow, the solution was then poured into an open tray. The tray was left in a fume hood for 16 hours. The resulting yellow rubbery mass remaining after air evaporation of the solvent was then cut into small pieces with a scissor. This material was then extracted extensively and repeatedly with 1,500 milliliters (three 500 milliliter portions) of n-hexane to remove unreacted siloxane.

Thereafter, 54.5 grams of the prepared silicone grafted fluoroelastomer, together with 495 grams of methyl isobutyl ketone, 1.1 grams of magnesium oxide and 0.55 gram of calcium hydroxide $(CaOH)_2$ were added to a jar containing ceramic balls followed by roll milling for 17 to 24 hours until a fine, 3 to 5 microns in diameter particle size of the fillers in dispersion was obtained. Subsequently, 2.5 grams of DuPont VITON CURATIVE VC50 TM catalyst crosslinker in 22.5 parts of methyl ethyl ketone were added to the above dispersion, shaken for about 15 minutes and the solids content reduced to 5 to 7 percent by the addition of methyl isobutyl ketone. Following hand mixing, the mixture was ready for spray coating.

EXAMPLE II

Device Fabrication

The volume graft composition of Example I was coated onto a 2.2 mil thick sheet of stainless steel. The sheet was abraided with sandpaper, degreased using methylene chloride, scrubbed with an abrasive cleaner, thoroughly washed with water and dried prior to spray coating and then cured in an oven at 260° C. for about 2 hours. The dried film thickness of the coating was 10.7 micrometers. The electroreceptor device produced does not contain a blocking layer. It was observed that the resulting dielectric coating had considerably better capacitive charging properties, and a higher development potential then a control device prepared from uncrosslinked or non-volume grafted VITON as described below in Comparative Example I and as indicated in the figures. That is, the device prepared from the volume graft composition of Example I charged to higher levels (400 to 500 volts versus about 200 volts) and maintained or stabilized voltage levels (about 400 volts versus less than 50 volts after 30 cycles) to a greater extent than the control device of Comparative Example I. XPS analysis indicated that the polysiloxane compound was uniformly distributed throughout the VITON fluoroelastomer matrix.

EXAMPLE III

The volume graft composition of Example I was coated onto stainless steel sheets as described in Example II to produce a series of dry film coatings of 12.5, 50 and 75 micrometers thickness. The coatings were dried at 50° C. for 16 hours and then at 200° C. for about 24 hours. Each dielectric coating was charged by an ionographic charging device of the type described in the aforementioned U.S. application Ser. No. 07/887,943, to generate an image pattern which was then developed using a magnetic brush developer. The toner image was transferred to paper and fused. The dielectric coating was cleaned of residual toner and recharged to develop several more images. The devices with coatings with 50 and 75 micrometers thick volume graft composition produced images accceptable to a trained observer with dense solid areas and sharp line and edge definition compared to the 12.5 micrometers thick volume graft coating composition device which images were not acceptable. XPS analysis indicated that the polysiloxane compound was uniformly distributed throughout the VITON fluoroelastomer matrix.

EXAMPLE IV

Device Fabrication

An imaging member was prepared as follows. An aluminum cylinder core substrate was grit blasted and degreased with solvent, dried and primed with an epoxy adhesive Thixon 300/301 over which a base coat comprising part A of 100 parts VITON GF, 30 parts of N990 carbon black, 15 parts MAGLITE Y(MgO) in methyl isobutyl ketone (MIBK) to a 15 percent solids mixture, and part B of 5 parts of VITON CURATIVE VC50 and 28.3 parts of MIBK. Part B was added to part A and roll milled for 45 minutes, then sprayed onto the primed core cylinder to a thickness of 150 micrometers after which the member was desolvated at ambient conditions for two days followed by a step cure of 2 hours at 38° C., 4 hours at 77° C., 2 hours at 177° C., and then the sprayed surface layer was sanded to a thickness of 5.5 mils. Next 250 g of VITON GF was dissolved in 2.5 liter of methylethyl ketone (MEK) by stirring at room temperature. This is accomplished by using a four liter plastic bottle and a moving base shaker. It takes approximately one hour to two hours to accomplish the dissolution depending upon the speed of the shaker. The above solution is then transferred to a 4 liter Erlenmyer flask and 25 ml of the amine dehydrofluorinating agent N-(2-aminoethyl-3 aminopropyl)-trimethoxy silane (A0700, available from Huls America Inc., Piscataway, N.J.) was added. The contents of the flask were then stirred using a mechanical stirrer while maintaining the temperature between 55° and 60° C. After stirring for 30 minutes, 50 mL of vinyl terminated polysiloxane (PS-441) was added and stirring continued for another ten minutes. A solution of 10 grams of benzoyl peroxide in a 100 mL mixture of toluene and MEK (80:20) was then added. The stirring was continued while heating the contents of the flask around 55° C. for another 2 hours. During this time the color of the solution turned light yellow. To this solution was added VITON CURATIVE No. 50 in a 3 to 7 percent solution. The outer layer of the electroreceptor was spray coated to a thickness of 50 micrometers using the above solution and cured according to Example II. When the above electroreceptor is used in an imaging system, it has proven to provide satisfactory imaging properties and performance. X-ray photoelectron spectroscopy characterization was performed on this imaging member as in Examples II and III with similar results; a uniform distribution of the polysiloxane throughout the elastomer film matrix was indicated.

COMPARATIVE EXAMPLE I

A control device was prepared in the same manner as the volume graft device of EXAMPLE II with the exception that only VITON® GF was used for the purpose of coating instead of volume grafted siloxane VITON GF that was prepared in Example I. The resulting device had a thickness of 13.7 micrometers.

The following procedure was used for testing each of the samples produced in the Example II and Comparative Example I. Typical results from this procedure for certain examples are depicted in the FIGS. 1 and 2. Each sample was individually mounted on the outside surface of an aluminum drum of about 3 inches in diameter. The drum and sample were rotated at about one second per cycle under a 5 cm long corotron wire mounted with the wire parallel to the drum axis and controlled by a TREK model 610B to provide a continuous fixed charge current level. Thus, during each cycle, the sample was provided a fixed charge Q. Simultaneously, 6 non-contact voltage probes, such as from a TREK model 565 electrostatic voltmeter, were mounted radially to the drum at several angular intervals at a common axial position to measure the surface potential of the sample at various times after charging. This procedure provides a voltage versus charge cycle and/or voltage versus charge for each sample and thus provides the inverse Q-V (charge versus voltage) characteristics relevant to electrical performance.

Figure 2:
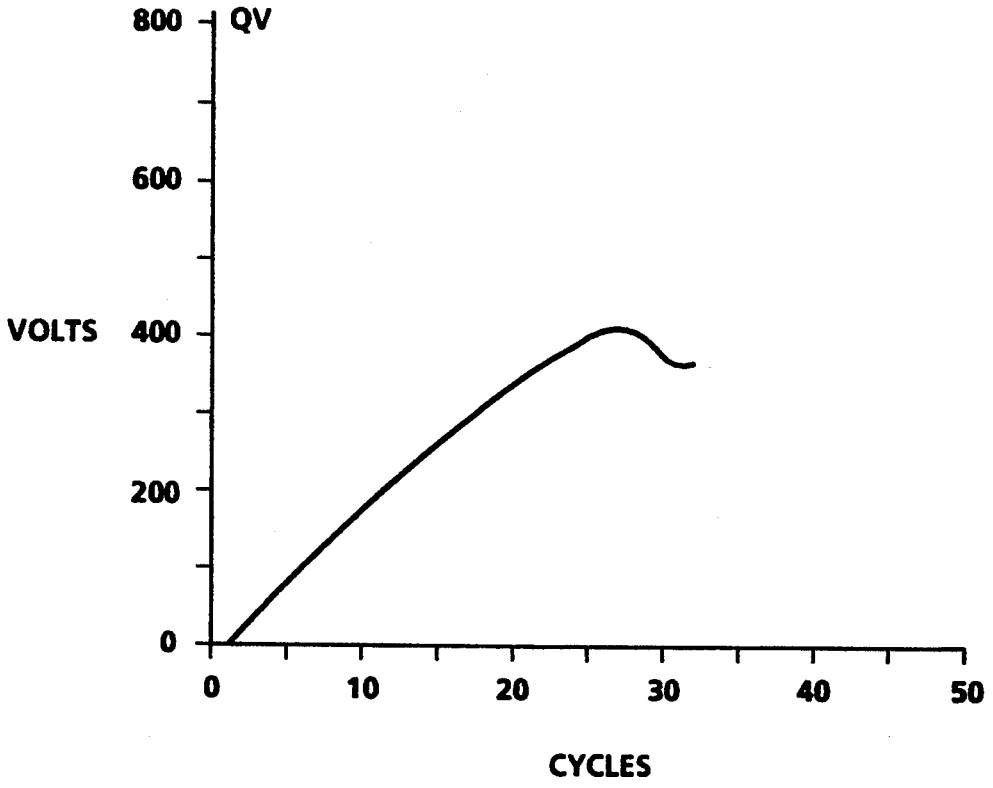

The QV curves shown in FIGS. 1 and 2, indicate charging at 26 nanocoloumbs/cm$^2$ each cycle for 25 cycles for devices fabricated from a control VITON® as described in COMPARATIVE EXAMPLE I and from the volume graft as prepared in EXAMPLE II of the present invention. The control sample reaches a level of 200 volts where all charges deposited during a one second cycle are lost due to charge decay mechanisms. That is the device of Comparative Example I does not charge capacitively and losses or leaks charge potential which retained charge is required for efficient charging, system stability and wider imaging process latitude. The volume graft prepared material of EXAMPLE II charges much more capacitively to over 500 volts. The device of EXAMPLE II charges capacitively, holds charge longer and thereby enables improved electrographic imaging processes. The control device is 13.7 micrometers in thickness whereas the volume graft prepared device is 10.7 micrometers thick.

All patents and copending applications referred to herein are hereby specifically incorporated by reference herein in their entirety.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. An electrographic imaging method comprising:

(a) providing an electroreceptor imaging member comprising: a supporting substrate, a conductive ground plane, an optional blocking barrier layer, an optional adhesive layer, and an outer charge retentive layer comprising a volume grafted elastomer which is a substantially uniform integral interpenetrating and crosslinked network of a hybrid composition comprising a polyorganosiloxane grafted fluoroelastomer;

(b) depositing a uniform electrostatic charge on the imaging member or discharging a receiving member to a low or uniform voltage;

(c) creating an electrostatic latent image by imagewise deposition of charged particles on the imaging member;

(d) developing the electrostatic latent image with electrostatically attractable marking particles to form a toner image using dry or liquid developer;

(e) transferring the toner image to the receiving member;

(f) optionally cleaning; and (g) optionally repeating the charging, image writing, developing, transferring, and cleaning steps.

2. The method of claim 1, wherein said fluoroelastomer is selected from the group consisting of poly(-vinylidenefluoride-hexafluoropropylene) and poly(-vinylidene fluoride-hexafluoropropylene-tetrafluoroethylene).

3. The method of claim 1, wherein said polyorganosiloxane is terminally functionalized and has the formula:

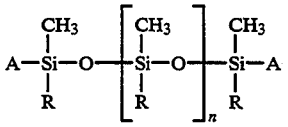

where R is independently an alkyl or alkenyl with from about 1 to 20 carbon atoms or an aryl group with from about 6 to about 20 carbon atoms wherein said aryl group may be substituted with an amino, hydroxy, mercapto or an alkyl or alkenyl group with from about 1 to 18 carbon atoms, the functional group A is an alkene or alkyne with from about 2 to 8 carbon atoms or an alkene or alkyne substituted with an alkyl group with from about 1 to 18 carbon atoms or substituted with an aryl group with from about 6 to 20 carbon atoms and n is a number from about 2 to about 350 and represents the number of disubstituted siloxane monomeric segments.

4. The method of claim 1, wherein the outer layer is from about 6 to about 200 micrometers thick.

5. The method of claim 1, wherein the supporting substrate is a cylindrical sleeve.

6. The method of claim 1 wherein the supporting substrate is a drum, endless belt or drum-belt hybrid.

7. The method of claim 1 wherein the imaging member further comprises an intermediate conductive elastomer layer.

8. The method of claim 1 wherein said substrate is a conductive metal selected from the group consisting of stainless steel, nickel and aluminum or has a conductive layer applied thereto.

9. The method of claim 1 wherein said member charges capacitively to at least 500 volts.

10. The method of claim 1 wherein the electrostatic charge on said member decays less than about 20%.

* * * * *